United States Patent [19]

Keimel et al.

[11] Patent Number: 5,000,161

[45] Date of Patent: Mar. 19, 1991

[54] SMOKESTACK HAVING REDUCED IR EMISSION

[75] Inventors: Robert W. Keimel; Arthur C. Keimel, both of Annapolis; John F. Thomas, Bowie, all of Md.

[73] Assignee: The United States of America as represented by the Secretary of the Navy, Washington, D.C.

[21] Appl. No.: 519,157

[22] Filed: Oct. 30, 1974

[51] Int. Cl.[5] ..... F23J 11/12

[52] U.S. Cl. ..... 126/307 R; 98/48; 126/518

[58] Field of Search ..... 126/307, 312, 120, 121; 98/45, 48, 58, 59, 60; 110/184; 114/187; 104/52

[56] References Cited

U.S. PATENT DOCUMENTS

| | | | |
|---|---|---|---|
| 1,966,620 | 7/1934 | Fluor, Jr. | 98/46 |
| 2,358,397 | 9/1944 | Howle | 98/48 |
| 2,713,301 | 7/1955 | McKann | 126/307 R |
| 3,190,281 | 6/1965 | Northwood | 126/518 |

*Primary Examiner*—David H. Brown

*Attorney, Agent, or Firm*—Luther A. Marsh

[57] ABSTRACT

An aircooled smokestack. The smokestack has passages within it for air or other cooling fluid. The fluid circulates through the smokestack, cooling off the internal and external surfaces. The cooling fluid is then aspirated into the stack gases near the top of the stack, thereby film cooling the upper portion of the interior of the stack. Cooling air is also aspirated into the flowing gases at the top of the stack, thereby cooling the gases as they leave the stack.

5 Claims, 1 Drawing Sheet

10
12
14
15
16
17
18
20
22
24
26
28
30
32
34
36
38
40
41
42
44
46
48
50
52
54
2
1

SMOKESTACK HAVING REDUCED IR EMISSION

The invention described herein may be manufactured and used by or for the Government of the Unites States of America for governmental purposes without the payment of any royalties thereon or therefor.

BACKGROUND OF THE INVENTION

The present invention is concerned with the detection of ships, and more specifically with the avoidance of detection of a ship by an infrared detector.

The most common means of guiding a missle onto a moving target are radar and heat-seeking devices. These latter guidance systems detect the infrared radiation emitted by all bodes above absolute zero, and then "home" in on the strongest source. When the target is a ship at sea, the job is made easier by the fact that the background, the ocean, is at a relatively constant temperature. Thus, it is easy for the detection system to pick out a ship, which is at a higher temperature than the ocean, against the relatively "flat" background.

Radar systems can be confused by dropping small pieces of metal foil, called "chaff", between the radar set and the target. The radar signals bounce off the chaff and show on the screen as a large blur. Attempting to confuse a heat-seeking guidance system in a similar manner is obviously impractical, since it would require large quantities of fuel to produce sufficiently large amounts of infrared radiation. Therefore, the only realistic way to avoid detection of a ship by a heat-seeking device is to reduce the temperature of all parts of the ship to that of the background, or to approach this temperature as nearly as possible.

On a ship, the highest external temperature exists in the stack gases and the smokestack itself. The smokestack and gases are considerably higher in temperature than the rest of the ship, hence, the heat-seeking guidance system would lock onto these sources and head for the ship. Therefore, it is necessary to cool the smokestack and gases.

The prior art shows an unrealistic and unworkable scheme for entirely eliminating a ship's exhaust by washing the soot particles out of it and discharging the cleaned and cooled gases at sea level. However, no workable prior art was found relating to the cooling of the smokestack and gases to eliminate infrared radiation.

SUMMARY OF THE INVENTION

Briefly, the present invention is a smokestack for a ship or fixed installation which is air cooled to reduce the infrared radiation emitted by the stack. Air or other cooling fluid is taken into a plenum chamber at the base of the stack and circulated through the stack. The cooling passages within the stack are directly beneath the interior and exterior surfaces of the stack. After being circulated through the cooling passages, the air is aspirated into the gas path within the stack; it then film cools the upper portion of the interior of the stack. Additional cooling air is caused to mix with the gases at the exit of the stack by a "halo" which surrounds the exit of the stack. Thus, the gases are surrounded by a layer of cool air which mixes with the hot gases as they leave the stack and halo.

OBJECTS OF THE INVENTION

Accordingly, it is an object of the present invention to provide a smokestack which has a reduced infrared radiation emission.

It is a further object of the present invention to provide an air cooled smokestack.

It is a further object of the present invention to provide a smokestack which has a "look" angle for infrared sensors that approaches 90° from the horizon.

Other objects and advantages of the present invention will be apparent from the following specification and accompanying drawings.

DESCRIPTION OF THE PREFERRED EMBODIMENT

Figures 1, 2:
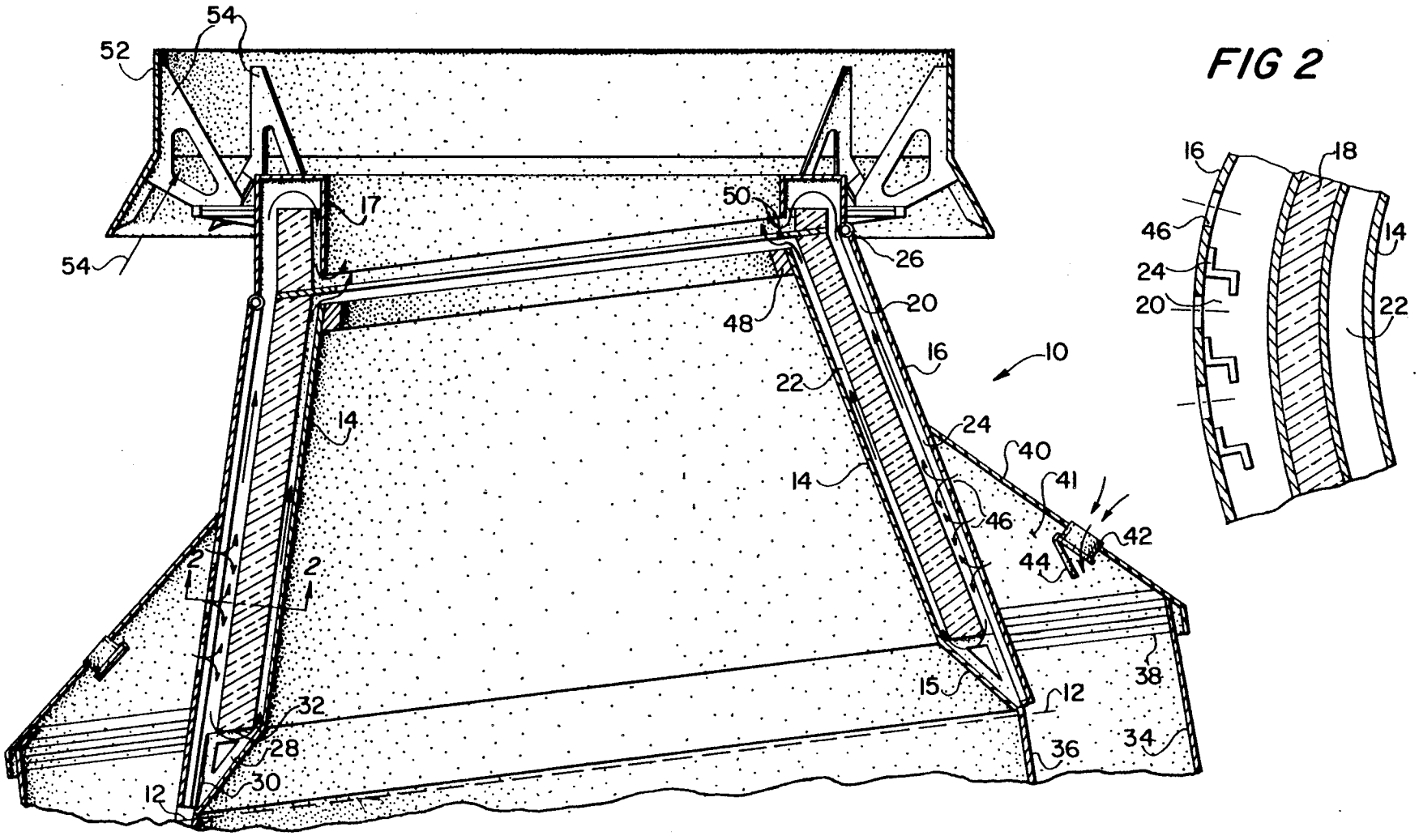
FIG. 1 is a cross section of a smokestack according to the present invention.
FIG. 2 is taken on line 2—2 of FIG. 1.

The present invention will be described as a smokestack for a ship; however, it will be obvious that it could be used in any installation where it is desired to reduce the infrared radiation emitted by a smokestack.

FIG. 1 shows the smokestack 10 in cross section. Smokestack 10 is comprised of three main parts: The surfaces which direct the gases; the cooling air channels, which cool the smokestack and thereby reduce its infrared emissions; and the halo, which directs additional cooling air into the gases as they leave the exit plane of the stack proper. Smokestack 10 is of conventional design below dashed line 12 in FIG. 1; its axis is raked slightly aft, which is in keeping with the design of ship smokestacks. The design of smokestack 10 below line 12 is a function of the power plant to which it is attached and forms no part of the present invention.

The stack gases are directed within the smokestack by an interior wall which is comprised of lower cylindrical segment 36, conical segment 15, interior surface 14, and upper cylindrical segment 17.

The interior cross section of smokestack 10 begins to converge above line 12 as can be seen in FIG. 1. As the walls converge, the gases within the smokestack are accelerated. This causes a drop in the static pressure of the gases as they flow up the smokestack, thereby allowing the gases to aspirate cooling air into the stack as will be explained later. The angle of convergence of the smokestack will be determined by the temperature, quantity, etc. of gases flowing up the stack.

The portion of smokestack 10 that is below line 12 in FIG. 1 will be protected by concentric shell 34.

The converging portion of smokestack 10 is comprised of interior surface 14 and exterior wall 16 with a body of insulation 18 between them. Channel 20 provides a path for the air which cools wall 16 and upper cylindrical segment 17; channel 22 provides a path for the air which cools surface 14 and conical segment 15. Insulation 18 is preferably a high temperature fiberglass insulation encases in metal; however, any suitable type of insulation may be used. Surface 14 and wall 16 are preferably of stainless steel; however, any other type of material which will withstand the temperatures and stresses to which they will be exposed may be used. Exterior wall 16 is strengthened by means of stiffeners 24 which extend up to reinforcing member 26, which is shown as a tube which encircles the smokestack. Stiffeners 24, which are spaced at intervals around the periphery of the smokestack, may have any suitable cross section which will provide the required strength.

Insulation 18 is supported on triangular members 28 which are spaced at intervals around the periphery of the smokestack and are welded in place as shown at 30 and 32.

The lower part of stack 10 is surrounded by a concentric shell 34 which is spaced a considerable distance from lower cylindrical segment 36 through which the gases flow. The distance between shell 34 and segment 36 insulates shell 34 from the heat of the gases flowing within segment 36. The top of this space is closed off by high temperature seal 38 which, as can be seen, is comprised of several layers of material. Seal 38 must be able to accommodate the difference in thermal expansion between shell 34, which remains relatively cool, and lower cylindrical segment 36, which expands when hot gases are flowing through it.

Truncated conical member 40 is placed over seal 38 as shown, and forms a plenum chamber 41 between itself, seal 38, and outer wall 16. A series of air inlet ports 42 is formed in conical member 40; each port has a door 44 on it, which is biased closed by a very weak spring. The spring on door 44 causes it to remain closed unless the wind is blowing toward that particular air inlet port. Thus, the prevailing wind is captured in the plenum chamber, and enters cooling air channels 20 and 22 through passages 46 in exterior wall 16.

Control over the exit flow of cooling air is achieved by means of reinforcing ring 48 and splitter plate 50, which are located near the top of the stack. These are shown as being placed perpendicular to the axis of the stack, and hence are at a slight angle to the horizontal. However, they could also be placed horizontally or at some other angle. Reinforcing ring 48 projects out into the flow path of the stack gases; when gases are flowing up the stack a low pressure region is created downstream of the reinforcing ring, which aspirates cooling air out of channel 22. Splitter plate 50 also projects out into the flow path, although not as far as reinforcing ring 48; thus, there is a low pressure region downstream of splitter plate 50 as well, which aspirates air out of cooling channel 20.

A wall of cooling air is created around the gases at the exit of the stack by means of "halo" 52. Halo 52 is supported by triangular members 54, which are spaced around the periphery of the top of the stack as shown.

Operation of the cooling system for the stack is as follows. Air enters plenum chamber 41 through those inlet ports 42 which face the direction of the prevailing wind. Doors 44 on those ports 42 which do not face the prevailing wind are closed by means of the small springs, thereby trapping air in plenum chamber 41 and building up a slight pressure within it. The air then enters cooling air channel 20 and divides as shown by the arrows. It is caused to circulate through cooling air channels 20 and 22 by the slightly higher pressure within plenum chamber 41 and the slightly lower pressure which exists at the exits of the cooling air channels. The air will also be circulated by convection currents which result from the increased temperature of the air in the cooling air channels compared to its temperature in the plenum chamber. After the air exits from the cooling air channels, it flows up along upper cylindrical segment 17, thereby serving to additionally cool this part of the stack.

The stack gases at the exit of the stack are at a lower than atmospheric pressure due to the fact that they have been accelerated by the converging cross section of the stack. This lower pressure causes cooling air to be drawn in through the bottom of halo 52 as shown by arrows 54; this air forms a wall around the hot stack gases, thereby, reducing the transmission of infrared radiation through it. Additionally, halo 52 serves to block the transmission of infrared radiation of the gases as they exit the stack.

When there is no relative wind, the aspirating action caused by reinforcing ring 48 and splitter plate 50 will be sufficient to cause some air flow through the cooling channels. This will cause enough air circulation in cooling air channel 20 to reduce the temperature of outer wall 16 to an acceptable level. Since halo 52 does not depend on any relative wind for its function, it will function as before.

At reduced load operation, the aspirating action of reinforcing ring 48 and splitter plate 50 will occur, but on a reduced scale. This will cause circulation of air through the cooling air passages, which will be increased of course by any relative wind. When there are no gases flowing up the stack, all interior surfaces will be at the same temperature and there will be no air flowing in channel 22. However, the sun's rays will heat a portion of exterior wall 16, raising the temperature of the air within channel 20 at that point. This will cause the air to rise in channel 20, thereby causing air to circulate within channel 20 and cool off the exterior wall.

Rain which enters plenum chamber 41 through inlet ports 42 is drained off by a series of "weep" holes (not shown) spaced around the periphery of the plenum chamber.

The smokestack of the present invention has a "look" angle which is considerably above the horizon. "Look" angle is defined as the angle above the horizon at which an infrared sensor must be in order to "see" a surface at a high enough temperature to emit infrared radiation which the sensor will detect above that of the background. This high look angle is a result of three factors. One is the fact that in order to look into the hot part of the stack, the sensor must be at an angle that is high enough for it to see over the top of the halo and into the stack. The second factor is that if the sensor is at an angle that is sufficiently high for it to see over the top of the halo into the exit plane of the stack, it will see radiation that is emitted by the cooled portion of the stack. The radiation emitted by this cooled portion of the stack will be insufficient to register on the sensor, due to the lower temperature of that portion of the stack. Therefore, the sensor will have to be at a higher angle, to look deeper into the stack at the higher temperature portion of the stack. The third factor is the ring of cooling air which is produced by the halo and which surrounds the stack gases. This cooling air mixes with the stack gases and cools them off as they exit from the stack, and it also serves to block some infrared radiation emitted by the gases. The net result of these factors is that the sensor must be at a considerable angle above the stack in order to see any surfaces that are hot enough to emit sufficient radiation. Thus, the stack is invisible to a sensor that is on the horizon or only slightly above it.

In all instances where details of construction or materials have been omitted, they are to be consistent with conventional smokestack construction.

Obviously, many modifications and variations of the present invention are possible in light of the above teachings. It is therefore to be understood that within the scope of the appended claims, the invention may be practiced otherwise than as specifically described.

What is claimed is:

1. A smokestack comprising:

converging interior and exterior walls having upper and lower portions with a layer of insulation between said walls;

a first fluid flow channel adjacent the lower portion of said interior wall;

a second fluid flow channel adjacent said exterior wall and the upper part of said interior wall;

means for causing fluid within said channels to be aspirated into said smokestack; and a plenum chamber which directs fluid into said fluid flow channels, said plenum chamber having inlets spaced around its outer periphery.

2. A smokestack as in claim 1 wherein said inlets have doors which open inward and are biased closed.

3. A smokestack as in claim 1 further including a member which surrounds the exit of said smokestack and is spaced therefrom.

4. A smokestack as in claim 1 further including exit slots in said interior wall for said first and second fluid flow channels, the exit slot of said first channel being located immediately upstream of the exit slot of said second fluid flow channel.

5. A smokestack as in claim 4 wherein the means for causing fluid within said channels to be aspirated into said smokestack comprises a splitter plate between said exit slots which prevents the fluid in either of said channels from entering the other of said channels and which projects into the converging flow path defined by said interior walls plus a member immediately upstream of the exit slot of said first fluid flow channel which projects into the flow path defined by said interior walls a greater distance than said splitter plate.

* * * * *